US011952175B2

(12) United States Patent
Messerschmid

(10) Patent No.: US 11,952,175 B2
(45) Date of Patent: Apr. 9, 2024

(54) CUP MADE OF PAPER OR PAPER-LIKE MATERIAL

(71) Applicant: Michael Hörauf Maschinenfabrik GmbH und Co. KG, Donzdorf (DE)

(72) Inventor: Uwe Messerschmid, Albershausen (DE)

(73) Assignee: MICHAEL HÖRAUF MASCHINENFABRIK GmbH Co. KG, Donzdorf (DE)

( * ) Notice: Subject to any disclaimer, the term of this patent is extended or adjusted under 35 U.S.C. 154(b) by 0 days.

(21) Appl. No.: 17/874,857

(22) Filed: Jul. 27, 2022

(65) Prior Publication Data

US 2023/0040519 A1 Feb. 9, 2023

(30) Foreign Application Priority Data

Aug. 4, 2021 (DE) ..... 102021208450.8

(51) Int. Cl.
*B65D 3/22* (2006.01)
*B65D 3/06* (2006.01)
(Continued)

(52) U.S. Cl.
CPC ..... *B65D 3/22* (2013.01); *B65D 3/06* (2013.01); *B65D 3/12* (2013.01); *B65D 3/28* (2013.01); *B65D 21/0233* (2013.01)

(58) Field of Classification Search
CPC ... B65D 3/04; B65D 3/06; B65D 3/22; B65D 3/28; B65D 3/30; B65D 81/3869
(Continued)

(56) References Cited

U.S. PATENT DOCUMENTS 5,363,982 A * 11/1994 Sadlier ..... B65D 3/22 493/111
5,415,339 A * 5/1995 Howard ..... B65D 3/06 229/103.11

(Continued)

FOREIGN PATENT DOCUMENTS

CN 110406757 A * 11/2019
EP 2452887 A1 5/2012

OTHER PUBLICATIONS

European Search Report issued in corresponding European Application No. 22187385.4 with English translation of categories of cited documents, dated Jan. 4, 2023 (16 pages).

(Continued)

*Primary Examiner* — Nathan J Newhouse
*Assistant Examiner* — Phillip D Schmidt
(74) *Attorney, Agent, or Firm* — FLYNN THIEL, P.C.

(57) ABSTRACT

Cup made of paper material having a fillable interior space formed by a shell and a base. The base via a skirt at the lower end of the interior space is fastened in a substantially liquid-tight manner to the shell, and a lower periphery of the skirt forms a footprint for the cup. The cup has an external shell composed of a planar blank of paper or paper-like material. Longitudinal edges of the blank are connected to one another in an overlap region so that the external shell forms a sleeve. The external shell has a frustoconical shape having a first cone angle and, except for the overlap region, from the predefined spacing to the lower end is configured in a single ply. The shell, from the predefined spacing to the lower end, at least in portions tapers more heavily than in the region above the predefined spacing.

18 Claims, 7 Drawing Sheets

(51) Int. Cl.
*B65D 3/12* (2006.01)
*B65D 3/28* (2006.01)
*B65D 21/02* (2006.01)

(58) Field of Classification Search
USPC ..... 229/400, 403, 404, 103.11, 4.5
See application file for complete search history.

(56) References Cited

U.S. PATENT DOCUMENTS 5,685,480 A * 11/1997 Choi ..... B65D 3/22 229/103.11
D386,947 S * 12/1997 Lapierre ..... D7/532
6,126,584 A * 10/2000 Zadravetz ..... B65D 81/3874 493/158
8,851,363 B2 10/2014 Stahlecker
8,875,986 B2 11/2014 Stahlecker
9,238,524 B2 1/2016 Messerschmid et al.
10,493,735 B2 * 12/2019 Ding ..... B32B 7/14
2007/0262129 A1 * 11/2007 Zadravetz ..... B65D 3/04 229/939
2010/0072268 A1 * 3/2010 Johnson ..... B65D 81/3869 229/403
2011/0240726 A1 10/2011 Stahlecker
2015/0083791 A1 * 3/2015 Gonzalez ..... B65D 3/06 29/428
2015/0360845 A1 * 12/2015 Stahlecker ..... B65D 81/3874 493/84
2017/0295969 A1 * 10/2017 Ben Ezri ..... B65D 3/06

OTHER PUBLICATIONS

European Search Report issued in corresponding European Application No. 22187385.4, with English translation of categories of cited documents, dated Apr. 25, 2023 (17 pages).

* cited by examiner

CUP MADE OF PAPER OR PAPER-LIKE MATERIAL

CROSS REFERENCE TO RELATED APPLICATION

This claims priority from German Application No. 10 2021 208 450.8, filed Aug. 4, 2021, the disclosure of which is hereby incorporated by reference in its entirety.

TECHNICAL FIELD

The invention relates to a cup made of paper, paperboard, or paper-like material having a fillable interior space formed by a shell and a base, wherein the base includes a skirt at the lower end of the interior space that is fastened in a substantially liquid-tight manner to the shell. A lower periphery of the skirt forms a footprint for the cup. The cup has an external shell, wherein the external shell is composed of a planar blank of paper or paper-like material. Longitudinal edges of the blank at least in portions are connected to one another in an overlap region so that the external shell forms a sleeve. The external shell, at least up to a predefined spacing from the lower end of the external shell, has a frustoconical shape having a cone angle and, with the exception of the overlap region, at least from the predefined spacing to the lower end, is configured in a single ply.

BACKGROUND AND SUMMARY

The intention of the invention is to improve a cup made of paper, paperboard, or paper-like material.

In the case of a cup according described herein, the lower region of the external shell, with the exception of the overlap region, is configured in a single ply, and the shell in the lower region, from the predefined spacing to the lower end, at least in portions, tapers more heavily than in the region above the predefined spacing. A constriction is thus provided on the external shell, at the lower end of the external shell forming a sleeve, without the lower end of the external shell being rolled in. As a result thereof, the external shell is not just easier to produce, but the external shell in the lower region thus also bears more tightly on the shell of the inner cup and, as a result, can be adhesively bonded to the shell in a simple manner, for example by hot-melt glue or hot-melt adhesive. The cup described herein is configured as a double-walled paper cup and an insulating air gap is configured between the external shell and the shell of the inner cup at least in the region where the cup is gripped. When the cup does not include rolling-in or folding-in at the lower end of the external shell, the lower end can be merely constricted and consequently tapers more heavily than the upper region of the external shell, such that a favourable ratio between the thickness of the insulation gap and a radial spacing between two stacked cups is achieved. This also facilitates the stacking of numerous cups of the same type. A substantial advantage of the cup also lies in the savings in terms of material when the lower end of the external shell is not rolled in or folded in. While the savings in terms of material in the case of each cup are only in the range of a few square centimetres, since the air-gap-insulated cups are single-use products, the cups can be produced in extremely large volumes and the cup is thus substantially more environmentally friendly than conventional cups when the lower end of the external shell is folded in or rolled in. An angle between the region of the external shell above the predefined spacing and the lower region of the external shell can be between 5° and 15°, if the lower region is configured so as to be smooth. If the upper region has an angle of 6° in relation to the central longitudinal axis, the lower region can lie at an angle of 11° to 21° in relation to the central longitudinal axis. If the constriction of the lower region is to be even more intense, indentations are required in the lower region of the external shell. The external faces of the external shell can be situated within an imaginary parallel to the shell delimiting the interior space, the parallel being placed on a largest diameter of the skirt. However, a stacking capability of a plurality of cups can also be achieved in another way.

The cup is produced from paper, paperboard or paper-like material. Such cups are usually also referred to as paper cups. A material which can be processed in a manner similar to paper or paperboard is referred to as paper-like material. Paper or paperboard comprises fibres and, consequently, can practically not be elongated and also can be compressed only to a very minor extent. Paper, paperboard or paper-like material can in particular not be deep-drawn, in general cannot be heavily deformed. Therefore, the shell, the base and the external shell have to be produced from separate, planar blanks when producing a cup from paper or paperboard. For example, a plastics material which cannot be stretched, or only to a very minor extent, is also considered a paper-like material. When producing a cup from such a paper-like plastics material, the shell, the base as well as the external shell have to be produced from planar blanks and adhesively bonded to one another in an overlap region.

The base and the shell of the cup are connected to one another in a substantially liquid-tight manner by a skirt. The term "substantially liquid-tight" here is understood to mean that the cup can be filled with cold beverages or hot beverages and then is liquid-tight for a specific time, for example for several hours. The skirt is formed, for example, such that a lower periphery of the shell is folded about a periphery of the base by 180°, and the shell and the base in the region of the skirt are then compressed and sealed to one another. The lower periphery of the base may also be folded about the lower periphery of the shell in order for the skirt to be formed.

Paper, paperboard or paper-like material which is coated on one side is normally used for producing the shell and the base. For example, paper, paperboard or paper-like material which is coated with a sealing-capable layer of plastics material on at least one side can be used. As a result, the lower periphery of the shell and the base only have to be heated and compressed when producing the skirt, with a liquid-tight sealed connection resulting in the process.

In a refinement of an embodiment of the invention, the shell in the lower region is configured so as to be frustoconical having a second cone angle, wherein the second cone angle is larger than the first cone angle.

In this way, a constriction can be designed in a very simple manner and so as to be visually appealing. In the case of paper, paperboard or paper-like material, it has to be considered here that the material has to be compressed when producing the constriction. As a result, the constriction cannot be embodied to all possible degrees if a visually appealing result is still to be achieved. The shell in the lower region, when viewed across the circumference, can also be configured so as to be frustoconical having a second cone angle only in portions. For example, when viewed in the circumferential direction, only mutually spaced-apart portions of the lower region of the external shell can bear on the shell of the inner cup, whereas other portions are disposed at a radial spacing from the shell of the inner cup.

In a refinement of an embodiment of the invention, the external shell in the region of the lower end thereof is connected to the external side of the shell of the inner cup, in particular sealed or adhesively bonded to the latter.

In this way, not only can a reliable fastening of the lower region of the external shell to the shell of the inner cup be achieved, but a stable composite comprising the external shell and the inner cup is produced at the same time. This is important because a filled cup is gripped on the external shell and in this case the air gap between the external shell and the inner cup in the gripping region must not be reduced to zero in the case of very hot beverages.

In a refinement of an embodiment of the invention, the external shell is connected to the shell by hot-melt glue or hot-melt adhesive.

The use of hot-melt adhesive in particular permits reliable fastening at very short cycle times. The connection between the external shell and the shell of the inner cup here can take place either in a region in which liquid is disposed in the interior space, or else in a region below the base of the inner cup, in which liquid is thus no longer disposed. Modern hot-melt adhesives are sufficiently temperature-resistant to be able to withstand the temperatures of hot liquids filled into the cup.

In a refinement of an embodiment of the invention, an adhesive bead between the external face of the shell and the internal face of the external shell is disposed at least across portions of the circumference of the shell and above the lower end of the external shell.

As a result, the adhesive bond between the external shell and the shell of the inner cup is not visible from the outside. For example, the adhesive bead is applied to the shell of the inner cup, and the external shell is then applied. The external shell here can either be pushed on as a completed sleeve from the base side of the inner cup or be wound onto the completed inner cup and only then be adhesively bonded. Moreover, the external shell can be sealed or adhesively bonded to the shell of the inner cup in a region below a mouth roll of the inner cup. The external shell at the upper end thereof can have a rolled-in formation to provide a sufficiently large air gap between the external shell and the shell of the inner cup. The inner cup may also have a recessed shoulder below the mouth roll, with the shoulder defining the air gap in this region.

In a refinement of an embodiment of the invention, the external shell in the lower region is configured so as to be corrugated, wherein the corrugation troughs, from the predefined spacing to the lower end, run so as to be perpendicular to the circumferential direction.

A constriction in the shape of a corrugation instead of a constriction which is uniform when viewed across the circumference is advantageous in the case of relatively large angles of the constriction, because the excess material arising in the constriction or taper, respectively, of the lower region of the external shell can be displaced into the corrugation peaks.

In a refinement of an embodiment of the invention, a corrugation height increases in the direction towards the lower end of the external shell.

In a refinement of an embodiment of the invention, the shell has a stacking shoulder which is recessed in the direction towards the interior space of the cup, the dimensions of the stacking shoulder correlating with the lower periphery of the skirt so that, when stacking an upper and a lower cup, the lower periphery of the skirt of an upper cup comes to bear on the stacking shoulder of the lower cup.

A very stable stacked composite of a plurality of cups can be formed in this way, so that even numerous cups, for example twenty cups or more, can be stacked on top of one another without the stacked cups jamming in one another.

In a refinement of an embodiment of the invention, the shell on the external side thereof has a reinforcement on the stacking shoulder.

This also contributes to a trouble-free stacking capability even of numerous cups.

Further features and advantages emerge from the following description of preferred embodiments in conjunction with the drawings. Individual features of the various embodiments illustrated and described here can be combined with one another in an arbitrary manner without departing from the scope of the invention. This also applies to the combination of individual features without further individual features that the former have been illustrated or described in conjunction with.

DETAILED DESCRIPTION

Figure 1:
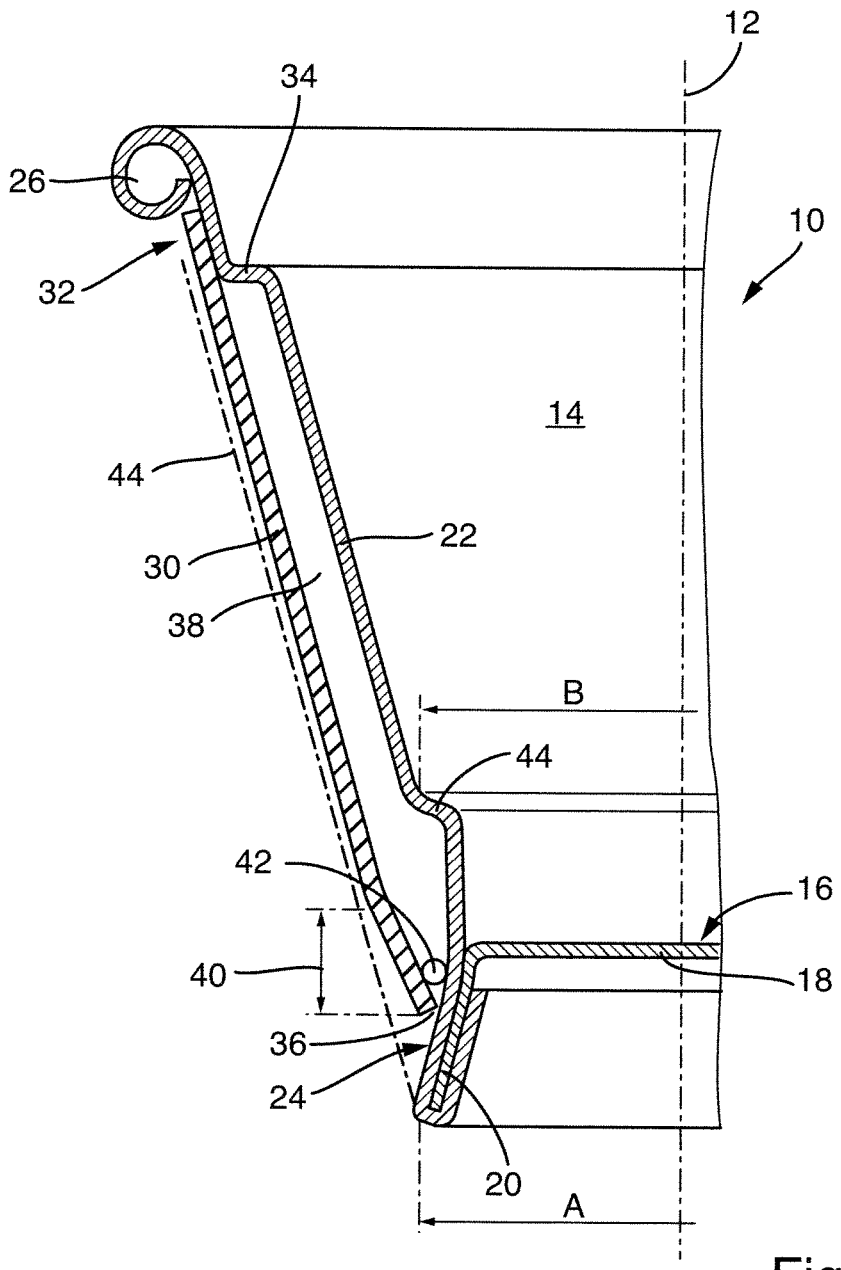
FIG. 1 shows a schematic illustration of portions of a cup according to the invention according to a first embodiment.

FIG. 1 schematically illustrates portions of a cup 10 according to the invention according to a first embodiment. The cup 10 is configured to be rotationally symmetrical about a central longitudinal axis 12.

The cup 10 has an interior space 14 which is open towards the top and towards the bottom is delimited by a base 16. The base 16 has a base plate 18 and a base collar 20. The base collar 20 extends from the base plate 18 towards the bottom, so that the base 16 has the shape of an inverted pot.

The interior space 14 is furthermore formed by a shell 22. The shell 22 at the lower periphery thereof is folded about the base collar 20 by 180°. The shell 22 and the base collar 20 are mutually compressed and sealed to one another at least in a part of the folded-over region and as a result form a skirt 24 which connects in a liquid-tight manner the shell 22 and the base 16 to one another. As a result, liquids, in particular hot or cold liquids, can be filled into the interior space 14 of the cup 10.

The shell 22 is rolled in at the lower periphery thereof and as a result forms a mouth roll 26. The mouth roll 26 forms the upper end of an inner cup from the shell 22 and the base 16. The mouth roll 26 makes drinking from the cup 10 comfortable.

The cup 10 is embodied as a double-walled, air-gap-insulated cup. The cup 10 has an external shell 30 which is configured in the manner of a sleeve. The external shell 30 is connected to the shell 22 in a region 32 below the mouth roll 26 and above a shoulder 34 that is recessed into the interior space 14. A connection can be established by hot-melt adhesive, for example. As a result, an air gap 38 between the external shell 30 and the shell 22 lies below the shoulder 34 and up to a lower periphery 36 of the external shell 30. The air gap 38 ensures that the external shell 30 can still be readily held by hand even when the interior space 14 is filled with very hot liquids.

The external shell 30 forms a frustoconical sleeve and, from the upper periphery thereof to a predefined spacing 40 from the lower end 36, is configured to be frustoconical having a first cone angle. From the predefined spacing 40 to the lower end 36 of the external shell 30, the latter is likewise embodied to be frustoconical having a second cone angle. The second cone angle here is larger than the first cone angle.

Consequently, the external shell 30 in the lower region thereof, thus from the predefined spacing 40 to the lower end 36, has a constriction in which the external shell 30 is more heavily tapered than in the upper region from the predefined spacing 40 to the upper periphery of the external shell 30.

The external shell 30, in the lower region thereof, just above the lower end 36 thereof, is adhesively bonded to the external side of the shell 22 of the inner cup by an adhesive bead 42. As a result, the external shell 30 and the inner cup form a stable unit. It is also achieved as a result that the external shell 30, even in the filled state, is not squashed when a user grips the cup 10 by hand and the air gap 38 in terms of the width thereof is consequently also not reduced to the extent that the external shell 30 becomes too hot and the user can no longer hold the cup 10.

The cup 10 can be stacked. To this end, the skirt 24 in the lower region thereof has a widening, and a maximum diameter A of the skirt 24 is present approximately at the lower periphery of the skirt 24. Moreover, the lower periphery of the skirt also forms the footprint for the cup 10. The shell 22 is provided with a stacking shoulder 44 which is recessed into the interior space 14 and which forms a bearing for the lower periphery of the skirt 24 of a further cup. A maximum diameter B of the stacking shoulder is the same size as the maximum diameter A at the lower periphery of the skirt 24, or is slightly larger than the maximum diameter A. As a result, an upper cup in the stacked state, by way of the lower periphery thereof, can bear on the stacking shoulder 44 of the lower cup. As a result, two or even more cups 10 stacked inside one another cannot become wedged but can be stacked and unstacked again in a very simple manner. This easy stacking capability and unstacking capability is also facilitated in that the external faces of the external shell 30 are situated in an imaginary parallel 44 to the shell 22 that delimits the interior space 14. As a result, a gap between the internal side of the shell 22 of a lower cup and the external face of the external shell 30 of an upper cup is provided even in the stacked state. This gap is referred to as stacking air.

Figure 2:
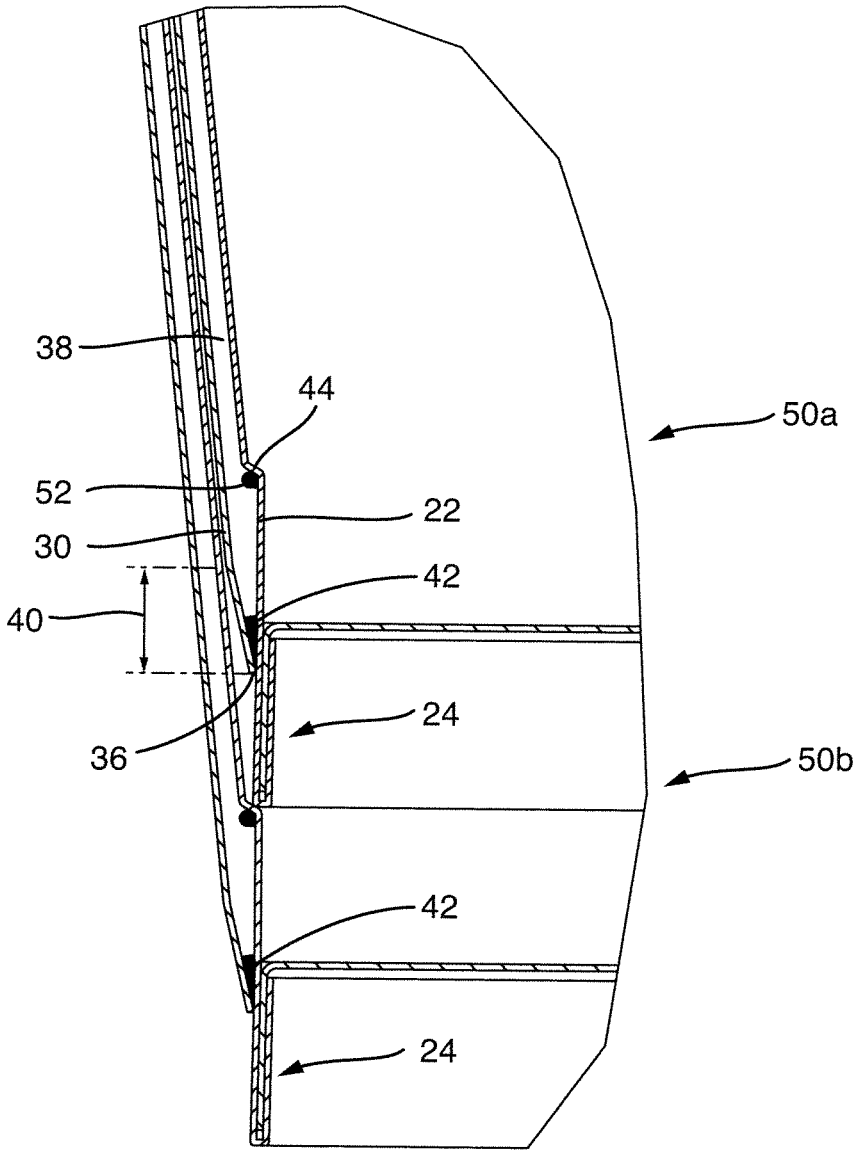
FIG. 2 shows an illustration of portions of two stacked cups according to the invention according to a second embodiment.

FIG. 2 in portions and in a sectional view shows two further cups 50*a*, 50*b* according to the invention according to a second embodiment. The cups 50*a*, 50*b* differ only slightly from the cup 10 of FIG. 1, so that only the points of differentiation will be explained hereunder.

The skirt 24 of the cups 50*a*, 50*b* is only slightly widened, which can barely be seen in the illustration of FIG. 2. This minor widening of the skirt 24 is sufficient because the air gap 38 between the external shell 30 of the cup 50*a* and the shell 22 of the cup 50*a* is comparatively small. Nevertheless, the air gap 38 is sufficient to have the effect of an adequate insulation of the double-walled cup 50*a*. The widening of the skirt 24 may be dispensed with. The cup 50*b* is configured to be identical to the cup 50*a* and will therefore not be separately explained.

The external shell 30, to the predefined spacing 40 from the lower end 36 of the external shell 30, is also frustoconical having a first cone angle in the case of the cup 50*a*. In the lower region of the external shell 30, thus from the predefined spacing 40 to the lower end 36, the shell 22 is then likewise frustoconical, but has a larger cone angle than in the upper region, so that the external shell 30 is constricted in the lower region, or, in other words, tapers more heavily than in the upper region. The differences between the first cone angle and the second cone angle in the case of the cup 50*a* are smaller than in the case of the cup 10 of FIG. 1. The predefined spacing 40 in the case of the cup 50*a* is larger than in the case of the cup 10 of FIG. 1.

Further to be seen in FIG. 2 is the adhesive bead 42 which connects and adhesively bonds the external shell 30 and the shell 22 of the inner cup. It can be seen on the stacking shoulder 44 of the shell 22 of the inner cup that a reinforcement 52 has been attached to the external face of the shell 22 on the stacking shoulder 44. For example, the reinforcement 52 can be configured as an adhesive bead applied across the entire circumference on the external face of the shell 22.

Figure 3:
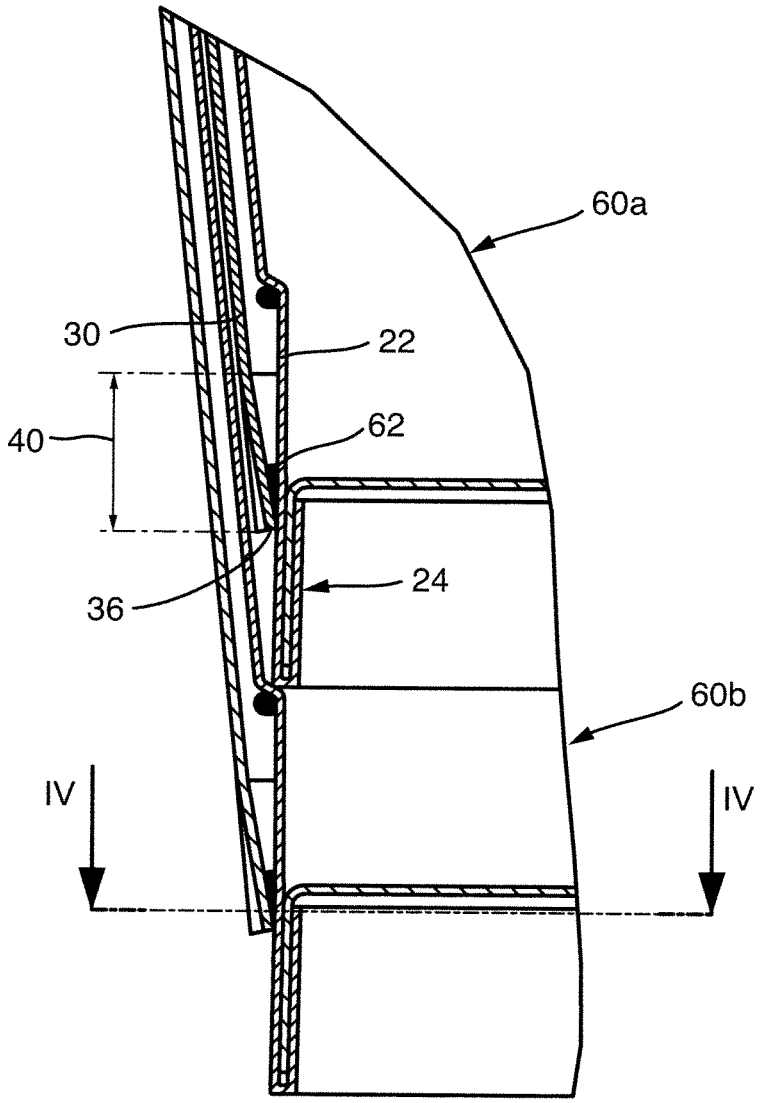
FIG. 3 shows a sectional view of portions of two stacked cups according to the invention according to a third embodiment.

The illustration of FIG. 3 in portions and in a sectional view shows two further cups 60*a* and 60*b* according to the invention stacked inside one another according to a third embodiment. The inner cups of the cups 60*a*, 60*b* are configured identically to the inner cups of the cups 50*a* and 50*b* of FIG. 2 and are therefore not explained again.

As opposed to the cups 50*a* and 50*b*, the cups 60*a* and 60*b* each have an external shell 30 which is corrugated in the lower region thereof, thus from the predefined spacing 40 to the lower end 36. With the exception of the design of the lower region from the predefined spacing 40 to the lower end 36 of the external shell 30, the external shell 30 of the cup 60*a* is configured identically to the external shell 30 of the cup 50*a* and is not explained further. The cup 60*b* is configured identically to the cup 60*a*.

In the case of the cups 60*a*, 60*b*, the external shell 30 bears on the shell 22 of the inner cup only in the region of the corrugation troughs of the corrugations. Therefore, only adhesive spots or adhesive drops 62, in particular of hot-melt adhesive, are provided in the region of the corrugation troughs, with the adhesive spots or adhesive drops 62 reliably connecting the external shell 30 to the shell 22.

The corrugated configuration of the external shell 30 in the lower region thereof facilitates the configuration of the constriction in the lower region because the excess material arising in the corrugation troughs during the constriction can be displaced into the corrugation peaks.

It can be derived from FIG. 3 that a corrugation height of the corrugation increases in the direction towards the lower end 36 of the external shell 30.

Figure 4:
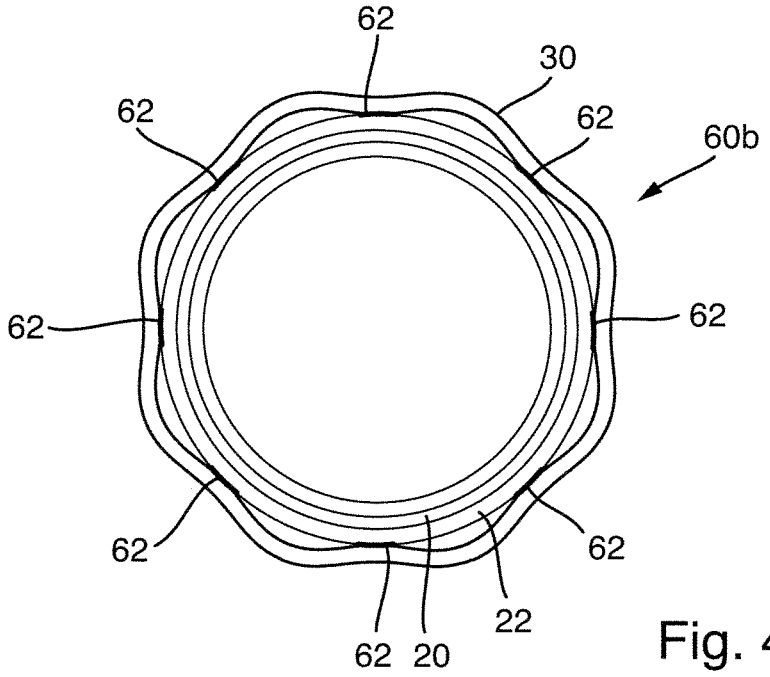
FIG. 4 shows a view onto the section plane IV-IV in FIG. 3.

FIG. 4 shows a sectional view of the cup 60*b* of FIG. 3 onto the section plane IV-IV in FIG. 3. The corrugated configuration of the external shell 30 can be readily seen in this view, and it can also be seen that the external shell 30 bears on the external face of the internal shell 22 only in the region of the corrugation troughs of said external shell 30. The adhesive spots 62 or adhesive drops are only indicated in the illustration of FIG. 4.

The cup according to an embodiment the invention permits the external shell 30 and the shell 22 of the inner cup to be connected by hot-melt glue or hot-melt adhesive. A substantial advantage of the cups 10, 50*a*, 50*b*, 60*a*, 60*b* according to an embodiment of the invention is that less material is required for the external shell 30 in comparison to a conventional external shell which is folded in or rolled in at the lower end.

Figure 5:
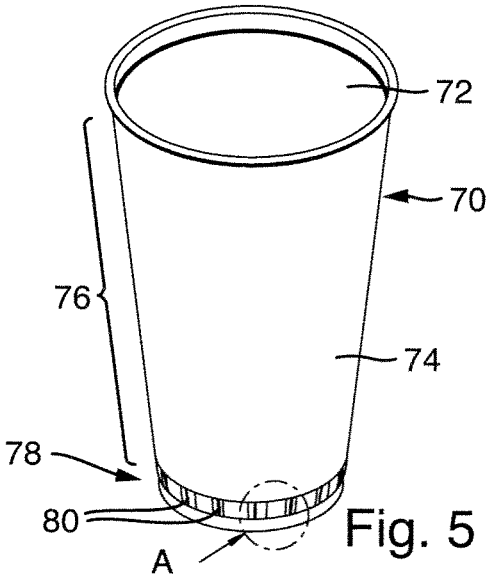
FIG. 5 shows a view of a cup according to the invention according to a fourth embodiment, viewed obliquely from above.
Figure 9:
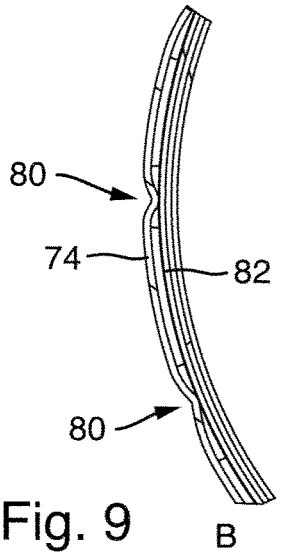
FIG. 9 shows the detail A from FIG. 7.

FIG. 5 shows a cup 70 according to a further embodiment of the invention. The cup 70 has an inner cup 72 and a sleeve-shaped external shell 74. The external shell 74 in the upper region 76 thereof has a frustoconical shape having a first cone angle, and in the lower region 78 thereof has a constricted shape which tapers more heavily than in the upper portion 76. As can be derived from FIG. 5, the lower region 78 has corrugations or indentations 80 which are uniformly distributed across the circumference. The external shell 74 bears on the shell 82 of the inner cup 72 in the region of these indentations or corrugations 80, as shown in FIG. 9.

Figure 6:
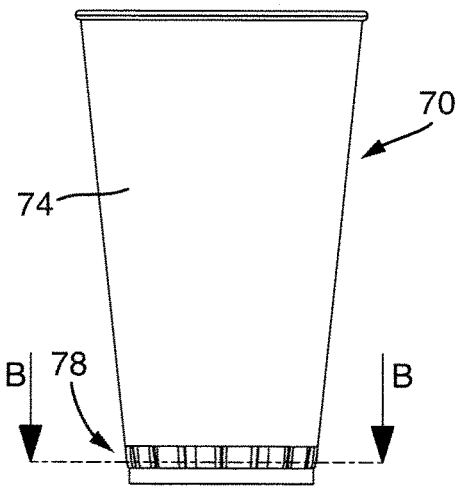
FIG. 6 shows the cup of FIG. 5 from the side.

FIG. 6 shows a lateral view of the cup 70 of FIG. 5 wherein a constriction or heavier tapering is present in the lower region 78 of the external shell 74 than in the upper region 76.

Figure 7:
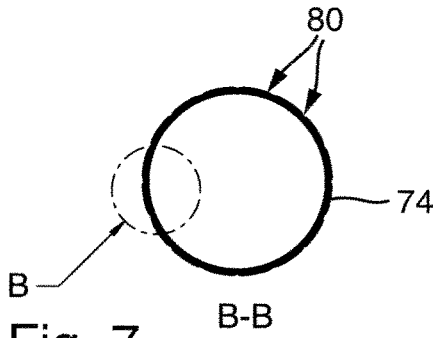
FIG. 7 shows a view onto the section plane B-B in FIG. 6.

FIG. 7 shows a view onto the section plane B-B in FIG. 6 wherein the corrugations or indentations 80 are uniformly distributed across the circumference of the external shell 74. The corrugations or indentations 80 can for example be impressed in the external shell using a tool (cf. also FIG. 9).

Figure 8:
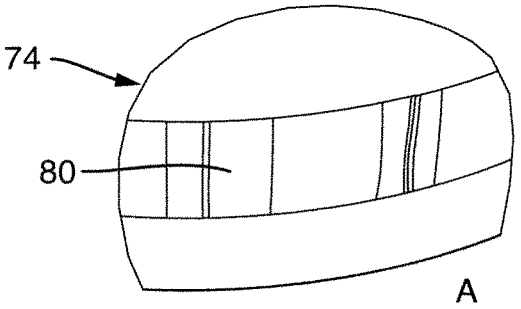
FIG. 8 shows the detail B from FIG. 5.

FIG. 8 shows the detail B from FIG. 5. The indentations or corrugations 80 on the external shell 74 can be clearly seen in this view.

Figure 10:
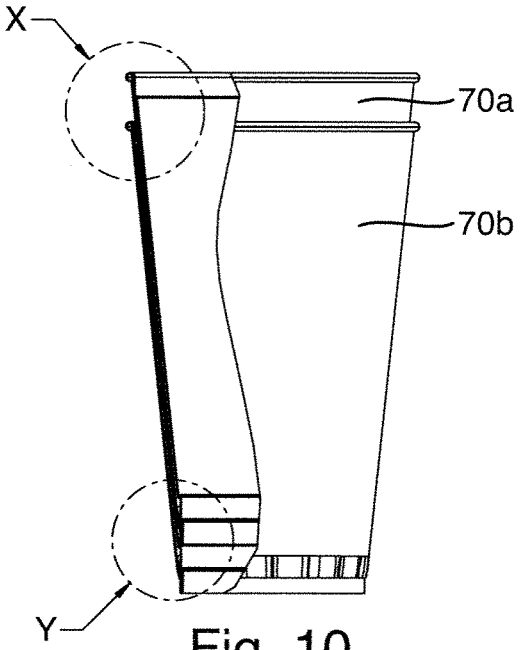
FIG. 10 shows a sectional view of two cups according to the invention according to FIG. 5, in the stacked state.

FIG. 10 shows two cups 70*a*, 70*b* according to an embodiment of the invention in the stacked state.

Figure 11:
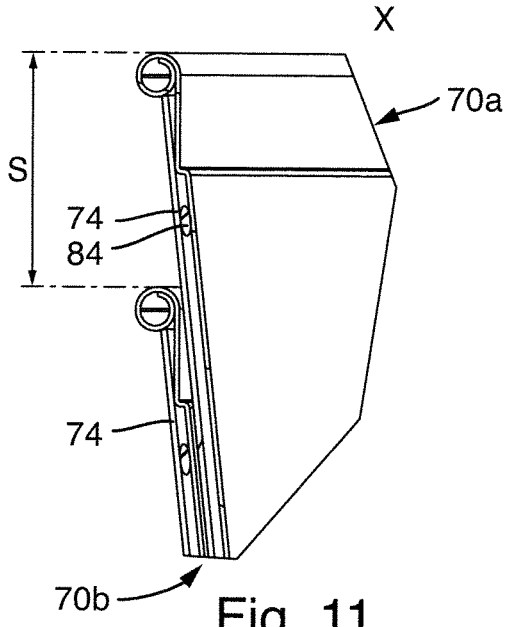
FIG. 11 shows the detail X from FIG. 10.

FIG. 11 shows the detail X from FIG. 10 wherein the external shell 74 of the cups 70*a*, 70*b* in each case abuts the lower side of a mouth roll. The upper periphery of the external shell here bears on a location of the mouth roll which lies in that half of the mouth roll that faces the inner cup. The upper periphery of the external shell 74 can therefore not readily slip radially outward, as this action is blocked by the mouth roll. The external shell 74 is connected to the external side of the shell of the inner cup by an adhesive bead or a plurality of adhesive spots 84, wherein this adhesive bonding by the adhesive bead or adhesive spots 84 is optional.

Figure 12:
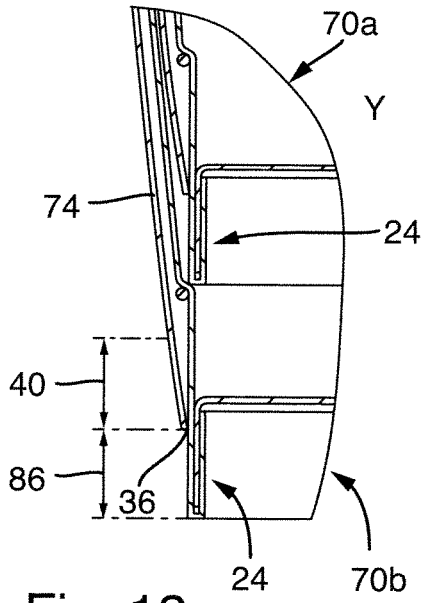
FIG. 12 shows the detail Y from FIG. 10.

FIG. 12 shows the detail Y from FIG. 10. It can be seen on the lower cup 70*b* that the external shell 74 between a predefined spacing 40 above the lower periphery 36 tapers more heavily than in the upper region above the predefined spacing 40. It can furthermore be seen in FIG. 12 that a spacing 86 from the lower periphery 36 of the external shell 74 to the lower periphery of the skirt 24 or to the footprint of the cup is the same size as the predefined spacing 40. This results in a visually appealing design of the cups 70*a*, 70*b*. It can furthermore be seen in FIG. 12 how the lower periphery of the skirt 24 of the upper cup 70*a* bears on the stacking shoulder on the lower cup 70*b*. As a result of the spacing between the stacking shoulder and the lower periphery of the skirt, a stacking height S between the respective upper ends of the cups 70*a*, 70*b* results, with the stacking height S being plotted in FIG. 11.

A widening of the skirts 24 is very modestly configured in the case of the cups 70*a*, 70*b* and can barely be seen in the illustrations of FIGS. 5 to 12. As has been explained, a widening of the skirts 24 may be dispensed with in the context of the invention.

Figure 13:
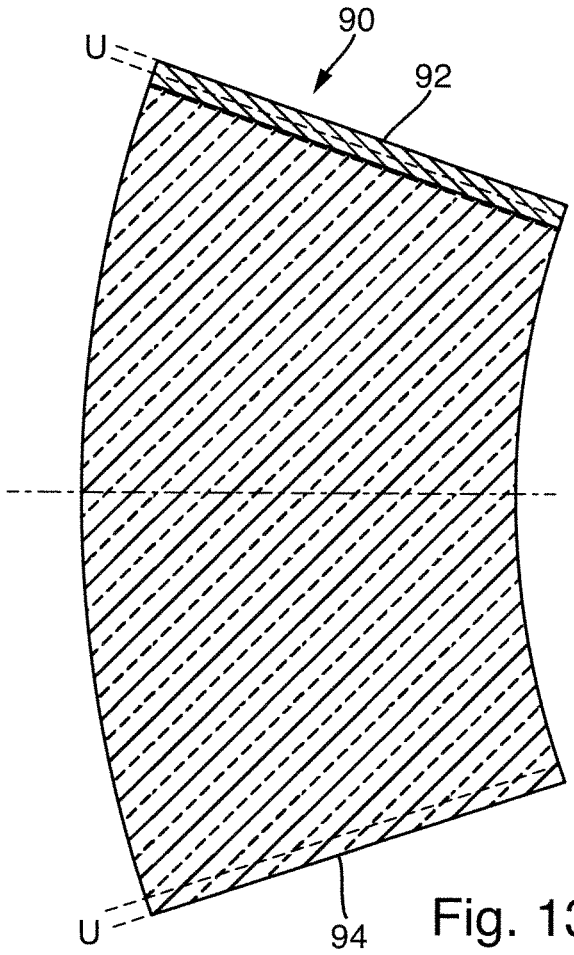
FIG. 13 shows a plan view onto a planar annular segment which is used for producing the external shell of the cup of FIG. 5.

FIG. 13 shows a planar annular segment 90 which can be used for producing the external shell 74 of the cup 70 of FIG. 5. The two longitudinal edges 92, 94 are connected to one another to produce a conical sleeve. This is formed by overlapping and adhesively bonding the regions adjacent to the longitudinal edges 92, 94. This results in an overlap region having a width U, which is plotted to be adjacent to the two longitudinal edges 92, 94 in FIG. 13.

Figure 14:
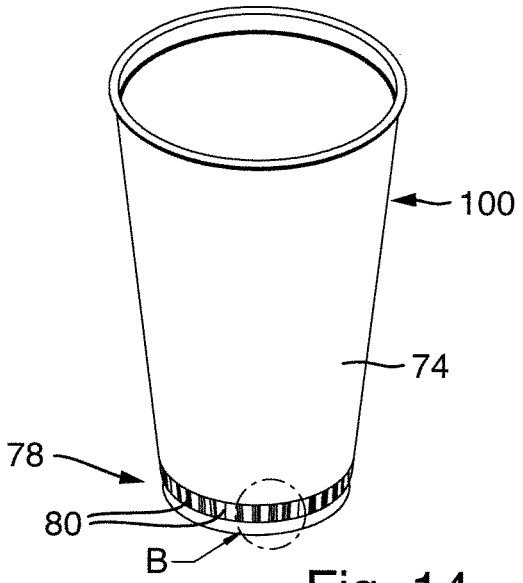
FIG. 14 shows an illustration of a cup according to the invention according to a fifth embodiment, viewed obliquely from above.
Figure 17:
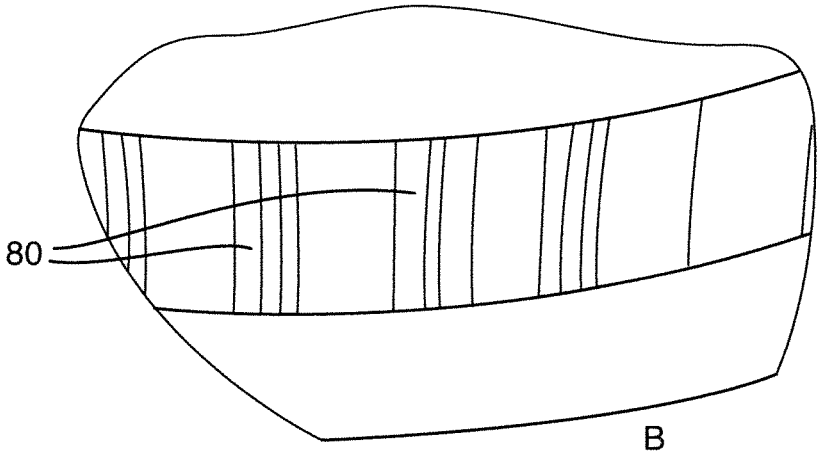
FIG. 17 shows the detail B from FIG. 14

FIG. 14 shows a cup 100 according to the invention according to a further embodiment. The cup 100 of FIG. 14 differs from the cup 70 of FIG. 5 only in terms of the design of the lower region 78 of the external shell 74. It can indeed be seen already in FIG. 14 that the corrugations or indentations 80 in the case of the cup 100 are not uniformly distributed across the circumference. The corrugations or indentations 80 arise randomly while constricting the lower region 78 of the external shell 74. This non-uniform distribution of the corrugations or constrictions 80 can also be seen in FIG. 17, the latter showing the detail B from FIG. 14.

In the production of the cups 70, 100, it is possible for the corrugations or indentations 80 to be applied already prior to the production of a sleeve from a planar segment 90 (see FIG. 13). In the context of an embodiment the invention, it is, however, also possible for a frustoconical sleeve to be first produced from the planar segment 90 and for the lower region of this planar sleeve then to be constricted and to be provided with the indentations or corrugations 80.

Figure 15:
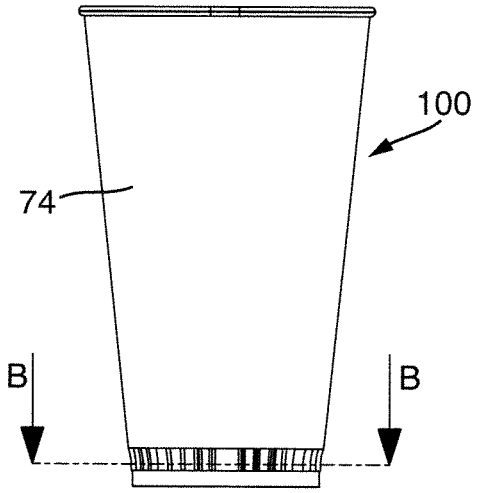
FIG. 15 shows a lateral view of the cup of FIG. 14.

FIG. 15 shows a lateral view of the cup 100 of FIG. 14.

Figure 16:
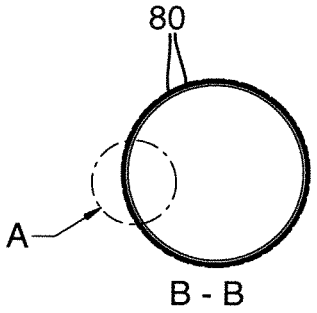
FIG. 16 shows a view onto the section plane B-B in FIG. 15.

FIG. 16 shows a view onto the section plane B-B in FIG. 15. The non-uniform and random distribution of the corrugations or indentations 80 across the circumference of the external shell 74 can be seen in FIG. 16.

Figure 18:
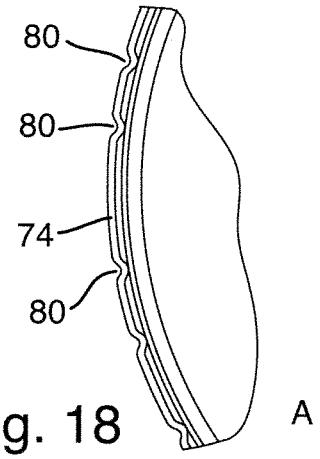
FIG. 18 shows the detail A from FIG. 16.

FIG. 18 shows the detail A from FIG. 16. The external shell 74 is connected to the shell of the inner cup only in the region of the indentations or corrugations 80.

The invention claimed is:

1. A cup comprising paper or paper-like material having a fillable interior space which is formed by a shell and a base, wherein the base at the lower end of the interior space is fastened in a substantially liquid-tight manner to the shell via a skirt, wherein a lower periphery of the skirt forms a footprint for the cup, wherein the cup further includes an external shell, wherein the external shell is composed of a planar blank of paper or paper-like material, longitudinal edges of said blank at least in portions being connected to one another in an overlap region so that the external shell forms a sleeve, wherein the external shell, at least up to a predefined spacing from a lower end of said external shell, has a frustoconical shape having a first cone angle and, with the exception of the overlap region, at least from the predefined spacing to the lower end is configured in a single ply, wherein the external shell in a lower region thereof, from the predefined spacing to the lower end, tapers at least in portions more heavily than in the region above the predefined spacing, wherein the external shell in the portions that taper more heavily than in the region above the predetermined spacing are connected to an external side of the shell.

2. The cup according to claim 1, wherein the external shell in the lower region is configured so as to be frustoconical having a second cone angle, wherein the second cone angle is larger than the first cone angle.

3. The cup according to claim 1, wherein the external shell in the region of the lower end thereof is sealed or adhesively bonded to the external side of the shell.

4. The cup according to claim 3, wherein the external shell is connected to the shell via hot-melt glue or hot-melt adhesive.

5. The cup according to claim 3, wherein adhesive between the external face of the shell and an internal face of the external shell is disposed at least over portions of a circumference of the shell and above the lower end of the external shell.

6. The cup according to claim 1, wherein the external shell in the lower region is configured so as to be corrugated, wherein corrugation troughs, from the predefined spacing to the lower end, run so as to be perpendicular to the circumferential direction.

7. The cup according to claim 6, wherein a corrugation height increases in the direction towards the lower end of the external shell.

8. The cup according to claim 1, wherein the shell has a stacking shoulder which is recessed in the direction towards the interior space of the cup, the dimensions of said stacking shoulder correlating with a lower periphery of the skirt so that, when stacking upper and lower cups, the lower periphery of the skirt of the upper cup comes to bear on the stacking shoulder of the lower cup.

9. The cup according to claim 8, wherein the shell on an external side thereof has a reinforcement on the stacking shoulder.

10. A cup comprising:

an inner cup portion and an external shell;

the inner cup portion is made paper or paper-like material and has a Tillable interior space;

the inner cup portion comprises an inner shell and a base;

the base being fastened in a substantially liquid-tight manner to the inner shell at the lower end of the interior space to form a skirt;

a lower periphery of the skirt forms a footprint for the cup;

the external shell is composed of a planar blank of paper or paper-like material, with longitudinal edges of the planar blank being connected to one another at least in portions and in an overlap region so that the external shell forms a sleeve;

the external shell includes an upper area with a frustoconical shape having a first cone angle and a lower area;

the lower area, with the exception of the overlap region, is configured in a single ply;

the lower area of the external shell tapers at least in portions more heavily than in the upper area; and the portions of the lower area of the external shell that taper more heavily than in the upper area are connected to an external side of the inner shell.

11. The cup according to claim 10, wherein the external shell in the lower area is configured so as to be frustoconical having a second cone angle, wherein the second cone angle is larger than the first cone angle.

12. The cup according to claim 10, wherein the external shell in the region of the lower area thereof is sealed or adhesively bonded to the external side of the inner shell.

13. The cup according to claim 12, wherein the external shell is connected to the inner shell via hot-melt glue or hot-melt adhesive.

14. The cup according to claim 12, wherein adhesive between the external face of the inner shell and an internal face of the external shell is disposed at least over portions of a circumference of the inner shell and above the lower area of the external shell.

15. The cup according to claim 10, wherein the external shell is corrugated in the lower area, wherein corrugation troughs run so as to be perpendicular to the circumferential direction.

16. The cup according to claim 15, wherein a corrugation height increases in the direction towards the lower area of the external shell.

17. The cup according to claim 10, wherein the inner shell has a stacking shoulder which is recessed in the direction towards the interior space, dimensions of the stacking shoulder correlating with a lower periphery of the skirt so that, when stacking upper and lower cups, the lower periphery of the skirt of the upper cup comes to bear on the stacking shoulder of the lower cup.

18. The cup according to claim 17, wherein the shell on an external side thereof has a reinforcement on the stacking shoulder.

* * * * *